US008191849B1

(12) United States Patent
Lembke

(10) Patent No.: US 8,191,849 B1
(45) Date of Patent: Jun. 5, 2012

(54) ADJUSTABLE HOOK

(76) Inventor: Nathan Lembke, Bentonville, AR (US)

( * ) Notice: Subject to any disclaimer, the term of this patent is extended or adjusted under 35 U.S.C. 154(b) by 138 days.

(21) Appl. No.: 12/658,847

(22) Filed: Feb. 16, 2010

Related U.S. Application Data

(60) Provisional application No. 61/154,928, filed on Feb. 24, 2009.

(51) Int. Cl.
*A47G 29/00* (2006.01)

(52) U.S. Cl. ..... 248/339; 248/304; 248/691; 248/692

(58) Field of Classification Search ..... 248/339, 248/340, 341, 304, 690, 691, 692; 211/87.01
See application file for complete search history.

(56) References Cited

U.S. PATENT DOCUMENTS

| | | | | | |
|---|---|---|---|---|---|
| 718,753 | A | | 1/1903 | Foss | |
| 859,660 | A | | 7/1907 | Hill | |
| 911,508 | A | * | 2/1909 | Look | 248/167 |
| 1,908,587 | A | * | 5/1933 | Olier, Jr. | 248/342 |
| 3,374,620 | A | | 3/1968 | Gower | |
| 3,692,269 | A | * | 9/1972 | Hales | 248/691 |
| 3,907,118 | A | | 9/1975 | Pelavin | 211/113 |
| 4,005,843 | A | | 2/1977 | Wengel | 248/220 |
| D250,742 | S | * | 1/1979 | Wendler | D8/372 |
| 4,174,087 | A | * | 11/1979 | Gaines | 248/339 |
| 4,385,742 | A | | 5/1983 | Rocquin | 248/318 |
| 4,880,192 | A | | 11/1989 | Vom Braucke et al. | 248/110 |
| 4,887,785 | A | | 12/1989 | Blaich | 248/339 |
| 5,330,244 | A | | 7/1994 | Rodwell | 294/143 |
| D375,889 | S | * | 11/1996 | Miller et al. | D8/367 |
| 5,664,304 | A | | 9/1997 | Tambornino | 24/599.1 |
| 6,230,440 | B1 | | 5/2001 | Deutsch | 47/67 |
| D444,052 | S | | 6/2001 | Catlett | D8/367 |
| 6,540,189 | B2 | | 4/2003 | Hsiang | 248/318 |
| 6,601,814 | B2 | | 8/2003 | Kovacik et al. | 248/339 |
| 6,866,940 | B1 | * | 3/2005 | Laughlin | 428/542.2 |
| 7,770,305 | B1 | * | 8/2010 | Krauss | 34/60 |

* cited by examiner

*Primary Examiner* — Terrell McKinnon
*Assistant Examiner* — Steven Marsh
(74) *Attorney, Agent, or Firm* — Keisling & Pieper PLC; Meredith K. Lowry

(57) ABSTRACT

The present invention relates to an adjustable hook with a rotating hook secured to a locking plate within a housing. The rotating hook is adapted to move within the housing allowing the orientation of the hook to be modified into a desired position. Once the desired position is achieved, the hook then locks in place.

17 Claims, 1 Drawing Sheet

ADJUSTABLE HOOK

CROSS-REFERENCE TO RELATED APPLICATIONS

This application claims priority to and is a continuation-in-part to U.S. provisional patent application Ser. No. 61/154,928 filed on Feb. 24, 2009, the entirety of which is incorporated by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

The present invention relates to the field of hanging implements in general. In particular, the present invention relates specifically to hooks.

2. Description of the Known Art

Hanging items are commonplace in residences and businesses. However, many of the hooks used to hang the items are static, which can result in the hanging item having an undesirable position or orientation. Previous swivel devices for suspending objects, although inexpensive, have been esthetically unattractive and did not permit ready adjustment of the angular orientation of pendant objects. Moreover, they could not be removed without leaving unsightly marks. Attempts have been made to provide an adjustable hook, but many of these hooks require permanent attachment to the surroundings or provide large, complicated housings which detract from the hanging item. Thus, there is a need to provide an adjustable hook that can be used for hanging items.

Details of adjustable hooks and hanging implements are contained in U.S. Pat. No. 718,753 issued to Foss on Jan. 20, 1903; U.S. Pat. No. 859,660 issued to Hill on Jul. 9, 1907; U.S. Pat. No. 3,374,620 issued to Gower on Mar. 26, 1968; U.S. Pat. No. 3,907,118 issued to Pelavin on Sep. 23, 1975; U.S. Pat. No. 4,005,843 issued to Wengel on Feb. 1, 1977; U.S. Pat. No. 4,385,742 issued to Rocquin on May 31, 1983; U.S. Pat. No. 4,880,192 issued to Vom Braucke, et al. on Nov. 14, 1989; U.S. Pat. No. 4,887,785 issued to Blaich on Dec. 19, 1989; U.S. Pat. No. 5,330,244 issued to Rodwell on Jul. 19, 1994; U.S. Pat. No. 5,664,304 issued to Tambornino on Sep. 9, 1997; U.S. Pat. No. 6,230,440 issued to Deutsch on May 15, 2001; U.S. Design Pat. No. D444,052 issued to Catlett on Jun. 26, 2001; U.S. Pat. No. 6,540,189 issued to Hsiang on Apr. 1, 2003; and U.S. Pat. No. 6,601,814 issued to Kovacik, et al. on Aug. 5, 2003. Each of these patents is hereby expressly incorporated by reference in their entirety.

U.S. Pat. No. 718,753 issued to Foss on Jan. 20, 1903 entitled Painter's Hook teaches a painter's hook for hanging a paint bucket while painting.

U.S. Pat. No. 859,660 issued to Hill on Jul. 9, 1907 entitled Double-Ended or S-Hook teaches a hook with both loops able to permit engagement or disengagement.

U.S. Pat. No. 3,374,620 issued to Gower on Mar. 26, 1968 entitled S-shaped Connector Device teaches a connector device making a connection between the ends of two lengths of chain.

U.S. Pat. No. 3,907,118 issued to Pelavin on Sep. 23, 1975 entitled Universal Hanger teaches a hanger for suspending garments, luggage and the like from any shape support which includes a mounting bracket supportable on any shape support and means connected thereto for releasably suspending a garment, luggage and the like therefrom. The mounting bracket comprises a substantially linear chord and a pair of downwardly turned lugs which depend therefrom. The lugs respectively depend from opposed ends of the chord at substantially oblique joints relative thereto. One of said lugs is foreshortened relative to the other. A thrust bearing is journalled into each lug and includes a bearing pad engageable with the surface of the support. Connected to the longer of the pair of lugs is a cantilevered arm at an obtuse angle with the lug from which it depends. The free end of the cantilevered arm is provided with means for pivotably, rotatably and slidably mounting a suspension means therefrom. One end of the suspension means is fixedly connected to the means provided in the cantilevered arm, and the other end thereof is provided with an S hook removably connected at one end to the suspension means and adapted at its other end to receive a garment bag, luggage, garment, or series of garments draped on conventional hangers.

U.S. Pat. No. 4,005,843 issued to Wengel on Feb. 1, 1977 entitled Hanging Display Rotator teaches a rotator for a hanging display such as a mobile, hanging plant or the like having a self-contained power supply. The apparatus comprises a cylinder for containing flashlight batteries adjacent one another and for containing motor means to drive a geared shaft by which a display is suspended and rotated. Off-on operation and series battery interconnection are effected by the positioning of a rotatable, electrically conductive circular top plate confronting the ends of the batteries. An opening in the rotatable plate is provided for replacement of the batteries. A tab on the top plate permits the plate to be rotated and to be suspended.

U.S. Pat. No. 4,174,087 issued to Gaines on Nov. 13, 1979 entitled Swivel Suspension Set teaches an overhead swivel suspension set that consists of a mount and a support, i.e. a grab. The set when assembled is used to hang an object, e.g. a floral display or an electric light fixture, from a ceiling or the like. The mount includes a base adapted to be secured to a ceiling, and a horizontal ring held below the base by pendant legs. The base, the legs and the ring are die cast as a single piece. The opening through the ring constitutes a vertical bearing. The upper surface of the ring serves as a horizontal step bearing. The ring is gapped over an arc of considerably less than 180.degree. to provide a radial slot. The support comprises a journal with a grab, e.g. a hook, at its lower end, and an enlarged head at its upper end. The journal, the grab and the head are die cast as a single piece. The journal is rotatable in the opening through the ring so that it can turn about a vertical axis in the mount. The diameter of the journal is greater than the width of the gap. The head rests on the upper surface of the ring. The grab is below the ring. The top of the grab has one transverse dimension narrower than the gap. To connect the support with the mount said narrower dimension of the upper end of the grab is slid through the gap until the journal is centered over the bore, then the journal is dropped into the bore until the head rests on the ring. This locks the support to the ring because the journal is larger than the gap. Such arrangement enables the swivel set to be of a very low height, this including the conjoint heights of the grab, the base, the ring, the journal and the head.

U.S. Pat. No. 4,385,742 issued to Rocquin on May 31, 1983 entitled Hanging Planter Apparatus teaches a support for suspending a flower pot from an overhead structure. In one embodiment the device comprises an annulus for engagement with the lower surface of a shoulder on the pot, the annulus having lateral projections for engagement with suspending hooks. In another embodiment the device comprises an annulus for engagement with the lower surface of an annulus lip on a plastic flower pot, the annulus having a plurality of projections extending upwardly through slots in the lip for engagement with suspending hooks.

U.S. Pat. No. 4,880,192 issued to Vom Braucke, et al. on Nov. 14, 1989 entitled Handled Tool Suspension Device teaches a device for suspending handled tools such as brooms, spades and rakes having hook means and mounting means for said hood means, said mounting means defining a pivot axis for said hook means, said pivot axis extending substantially horizontally, said hook means having a front elevation which is substantially S-shaped and comprising a mounting shaft portion located in said mounting means so as to be pivotable about said horizontal axis, a linear portion extending substantially at right angles to said mounting shaft portion in a generally downward direction, a further portion extending in a substantially horizontal plane from said linear portion, said further portion being substantially C-shaped or S-shaped in plan view, and a hook portion extending from said further portion.

U.S. Pat. No. 4,887,785 issued to Blaich on Dec. 19, 1989 entitled Hanger hook teaches a hanger hook is of modified S shape and all parts of the hanging hook lie substantially in the same plane. The hook has utility particularly but not exclusively in hanging a birdfeeder from a substantially horizontal tree branch and the like. The hook has a lower open loop providing a bite for receiving thereover the circular portion of a birdfeeder or plant hanger. The hanger also has an upper open loop for receiving the branch. The hook resists efforts of squirrels, raccoons, or the like but not people to disassemble the hanger from the hook and to disassemble the hook from the branch.

U.S. Pat. No. 5,330,244 issued to Rodwell on Jul. 19, 1994 entitled Advertising Base and Clothes Hanger Carrier teaches an advertising base, handle and hanger receiver. The advertising base has a communications area wherein advertising media may be imprinted. The base has a conveniently contoured hand hold cut out so that the base may be comfortably carried in one hand, while a plurality of clothing bearing hangers is supported from the advertising base. The base also includes a hanger hook so that the base may be hung on the clothes hanger hook in an automobile or on a clothing support rod in a closet.

U.S. Pat. No. 5,664,304 issued to Tambornino on Sep. 9, 1997 entitled S-Hook with Safety Latch teaches a safety latched hook with a hook link, a latch and a spring biasing the latch to a closed position. The hook link has a bend in a closed side opposite a latch end. The a chain attachment opening, defined as the distance from the latch end to the closed side, is at least as wide as the thickness of the material for the hook link. The hook can receive a chain of the same thickness material within the chain turn of the hook link, and does not require any further attachment mechanism to attach to a chain.

U.S. Pat. No. 6,230,440 issued to Deutsch on May 15, 2001 entitled Rotating Display Device teaches a rotatable display device that is suspendable from a ceiling and allows a planter to be rotatably suspendable therefrom. The device includes a lower housing. An upper housing is replaceably attached to the lower housing. A top hanger assembly extends upwardly from the upper housing and suspends the rotatable display device from the ceiling while providing a means for grabbing the upper housing when the upper housing is to be removed from the lower housing. A rotatable plate is contained in, and rotatable relative to, one of the lower housing and the upper housing. A bearing assembly rotatably connects the rotatable plate to the other of the one of the lower housing and the upper housing. A driven gear is fixedly attached to, for rotation with, the rotatable plate. A bottom hanger assembly extends downwardly from, and rotates with, one of the rotatable plate and the driven gear for rotatably suspending the planter therefrom. A motor is contained in the other of the one of the lower housing and the upper housing for rotating the rotatable plate. A motor shaft extends from the motor. A driver gear is fixedly attached to the motor shaft for rotation therewith and is contained in the lower housing, and is rotatably operatively connected to, the driven gear.

U.S. Pat. No. 6,540,189, issued to Hsiang on Apr. 1, 2003 entitled Rotatable Hanger teaches a rotatable hanger adapted for suspendedly hanging on a building structure, the hanger including a hanging means and a supporting means rotatably affixed to the hanging means, wherein the supporting means includes a top plate connected to the hanging means, a base plate for supporting an ornamental object thereon, and at least two adjustable belts connecting the top plate to the base plate, in such a manner the ornamental object is adapted to be rotatably supported on the supporting means for selectively showing a lateral view of the ornamental object.

U.S. Pat. No. 6,601,814 issued to Kovacik, et al. on Aug. 5, 2003 entitled Rotatable Hook Mount for Utility Light teaches a rotatable hook mount apparatus for suspending a utility light which includes a first locking member attached to a light guard of the utility light and a second locking member attached to a shaft portion of a hook. The shaft portion is rotatably received in a bore formed in the first locking member. Adjacent faces of the locking members have cooperating teeth for preventing relative rotation. A spring biases the teeth into engagement and the second locking member with the attached hook can be moved against the spring bias to disengage the teeth for rotation of the hook relative to the light guard.

These prior art patents are very limited in their teaching and utilization, and an improved adjustable hook is needed to overcome these limitations.

SUMMARY OF THE INVENTION

The present invention is directed to an improved device for hanging objects. Standard s-hooks do not allow for modifying the position of the s-hook to provide the best orientation of hanging item. It is therefore an object of the present invention to provide a hook device that accommodates the user. The hook device includes a housing with a hook on the top for attachment to a structure and a bottom hook for attachment to a hanging object. The bottom hook is connected to a locking plate within the housing which can be releasably attached to the bottom of the housing. The position of the bottom hook can be adjusted by rotating the locking plate when it is released from the bottom of the housing. In this manner, the adjustable hook can be modified to orient a hanging object in various positions.

It is an object of the invention to provide a new and improved device for hanging items.

It is an object of the invention to provide a hook adapted to rotate hanging items.

It is another object of the invention to provide an adjustable hook which easily can be hung.

It is another object to provide an adjustable hook that is allows for the hook position to be rotated and that is firmly secured after rotation.

It is another object of the invention to provide an adjustable hook with a low profile and low visibility housing allowing for adjustable positioning of the hook.

Other objects of the invention in part will be obvious and in part will be pointed out hereinafter. These and other objects and advantages of the present invention, along with features of novelty appurtenant thereto, will appear or become apparent by reviewing the following detailed description of the invention.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
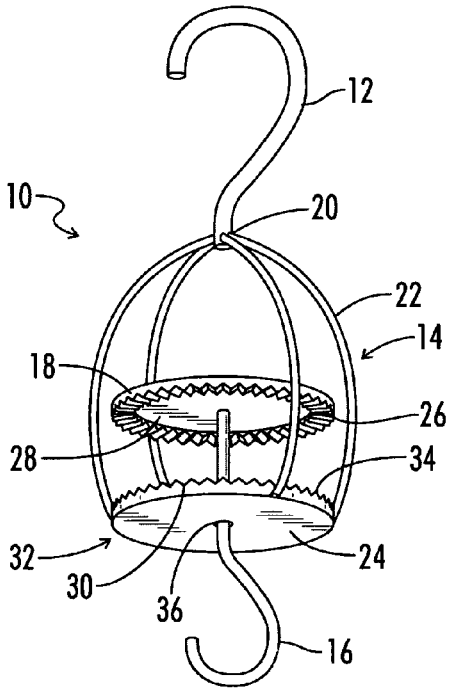
FIG. 1 is perspective view showing my new and improved adjustable hook invention.

The present invention relates to an adjustable hook 10 with a stationary hook 12 attached to a housing 14 and a rotating hook 16 secured to a locking plate 18 within the housing 14. The rotating hook 16 is adapted to move within the housing 14 allowing the orientation of the hook 16 to be modified into a desired position. Once the desired position is achieved, the hook then locks in place.

The stationary hook 12 is designed to hook onto a wire, an eye hook, nail, or other anchor that has been mounted into a ceiling or other structure. The stationary hook 12 is typically constructed of steel, but may also be constructed of another metal, a composite metal, or any other sufficiently strong material. The stationary hook 12 is connected to the housing 14. As shown in the drawings, the stationary hook 12 is connected to the apex 20 of the housing 14, but it is envisioned that the stationary hook could be attached to any of the sides of the housing 14.

As shown in the drawings, the housing 14 can be constructed of a series of ribs 22 secured to and running from the apex 20 of the housing 14 to the base plate 24. As shown, the hook device 10 uses four ribs 22 for the housing 14. The ribs 22 and base plate 24 of the housing 14 are typically constructed of steel, but may also be constructed of another metal, a composite metal, or any other sufficiently strong material. The ribs 22 form a partially enclosed housing structure 14 that encases the locking plate 18. The housing 14 can be composed of any number of ribs 22 as needed to support the weight of the item hung from the adjustable hook 10. In another embodiment, the housing 14 can include walls (not shown in the drawings) on the exterior of the housing 14. The ribs 22 may or may not be used to form the apex 20 of the housing by a twisting or molding of the ribs 22 to form the solid area of the apex. The twisted ribs 22 may also continue up from the apex 20 to form the stationary hook 12. At the base 32 of the housing 14 is the base plate 24. As shown, the base plate 32 is substantially flat with a series of grooves 30 on the top 34 of the base plate 32. The grooves 30 run the length of the circumference of the base plate 32. The base plate 24 as shown is disc-shaped, however, it is envisioned that the base plate 24 can be a variety of shapes with an interior groove structure that is the same shape and size as the locking plate 18. For instance, if the base plate 24 is square, the interior groove structure 30 could be the same circular shape as the locking plate 18.

The locking plate 18 is a disk-shaped piece of metal, composite metal, or any other sufficiently strong material. As shown, the locking plate 18 is substantially flat with a series of ridges 26 on the underside 28 of the locking plate 18. The ridges 26 run the length of the circumference of the plate 18. The ridges 26 are adapted to fit within corresponding grooves 30 on the base plate 24 of the housing 14. In this manner, the ridges 26 are frictionally engaged by the grooves 30 when the hook 10 is placed in a locked position. It is envisioned that the locking plate 18 and base plate 24 may also be magnetized to further secure the locked position. The ridges 26 and grooves 30 likewise could be modified or replaced with hook-and-loop fasteners, pins, ball-and-detent structures or other known securing structures.

Figure 2:
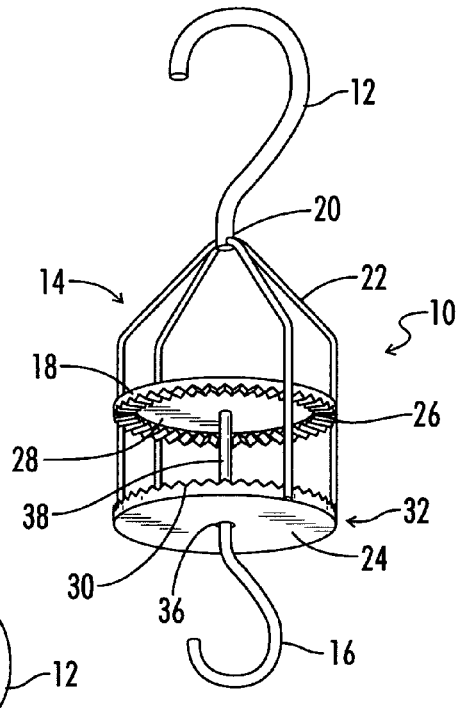
FIG. 2 is a perspective view of another embodiment of my invention, showing the locking plate in an unlocked position.
Figure 3:
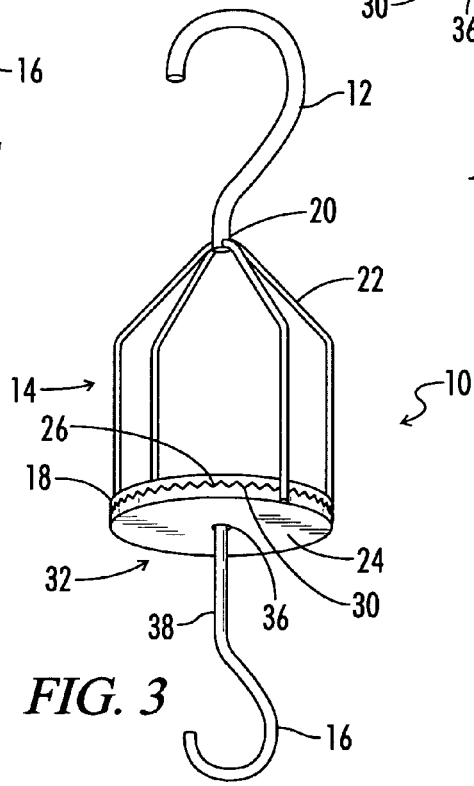
FIG. 3 is a perspective view of the same showing the locking plate in a locked position.

The rotating hook 16 is designed to hook onto a wire, an eye hook, nail, or other anchor that has been mounted onto an item for hanging, such as a bird feeder or potted plant. The rotating hook 16 is typically constructed of steel, but may also be constructed of another metal, a composite metal, or any other sufficiently strong material. Both the rotating hook 16 and the stationary hook 12 are typically the same size, but could be different sizes also. The rotating hook 16 is connected to the underside 28 of the locking plate 18 by a shaft 38 running through an aperture 36 in the center of the base plate 24. The end of the shaft 38 terminates into the hook of the rotating hook. In this manner, when the locking plate 18 is lifted from the base plate 24 to an unlocked position (shown in FIG. 2) within the housing 14, the locking plate 18 can be rotated to reorient the rotating hook 16 to the desired position. Once the desired position is found, the locking plate 18 can then be lowered to a locked position (shown in FIG. 3), reengaging the ridges 26 of the locking plate 18 with the grooves 30 of the base plate 24.

It is envisioned that size and shape of the various elements can be modified to be more aesthetically pleasing. Likewise, the stationary hook 12 and rotating hook 14 could be changed to a clasp type fastener or other similar fasteners. Additionally, the stationary hook 12 could be replaced with a second rotating hook 14, the housing having two locking plates engaged by base plates.

From the foregoing, it will be seen that this invention well adapted to obtain all the ends and objects herein set forth, together with other advantages which are inherent to the structure. It will also be understood that certain features and subcombinations are of utility and may be employed without reference to other features and subcombinations. This is contemplated by and is within the scope of the claims. Many possible embodiments may be made of the invention without departing from the scope thereof. Therefore, it is to be understood that all matter herein set forth or shown in the accompanying drawings is to be interpreted as illustrative and not in a limiting sense.

What is claimed is:

1. An adjustable hook device adapted for hanging items from a structure, the hook device comprising:

a housing having a base plate with an aperture;

a stationary hook secured to said housing; and a rotating hook secured to a rotating locking plate adapted to move within said housing, said rotating hook having a shaft extending through said aperture of said base plate and connected to said locking plate, said rotating locking plate having at least one ridge on the underside of said locking plate and adapted to move from a locking position to an unlocked position, said unlocked position allowing a user to reposition said rotating hook to an alternative position for hanging items and said locked position secured to said base plate of said housing thereby preventing movement of said rotating hook.

2. The adjustable hook of claim 1, said locking plate having an attachment means for securing to said base plate.

3. The adjustable hook of claim 1, said locking plate and said base plate having a magnet attachment.

4. The adjustable hook of claim 1, said base plate having at least one groove corresponding to said at least one ridge on said locking plate.

5. The housing of claim 1 further comprising at least two ribs forming the exterior of said housing.

6. The housing of claim 1 further comprising an exterior shell enclosing said locking plate.

7. An adjustable hook device adapted for hanging items from a structure, the hook device comprising:

a housing having at least one base plate with an aperture;

a hook secured to said housing; and a rotating hook secured to a rotating locking plate adapted to move within said housing, said rotating hook having a shaft extending through said aperture of said at least one base plate and connected to said locking plate, said rotating locking plate having at least one ridge on the underside of said locking plate and means for securing to said at least one base plate and adapted to move from a locking position to an unlocked position, said unlocked position allowing a user to reposition said rotating hook to an alternative position for hanging items and said locked position secured to said at least one base plate of said housing thereby preventing movement of said rotating hook.

8. The adjustable hook of claim 7, said locking plate and said at least one base plate having a magnet attachment.

9. The adjustable hook of claim 7, said at least one base plate having at least one groove corresponding to said at least one ridge on said locking plate.

10. The housing of claim 7 further comprising at least two ribs forming the exterior of said housing.

11. The housing of claim 7 further comprising an exterior shell enclosing said locking plate.

12. The adjustable hook of claim 7, said locking plate having a ridge series running along the circumference of said locking plate on the underside of said locking plate.

13. The adjustable hook of claim 12, said at least one base plate having a groove series running along the circumference of said base plate and corresponding to said ridge series on said locking plate.

14. An adjustable hook device adapted for hanging items from a structure, the hook device comprising:

a housing having at least one base plate, said base plate having an aperture and at least one groove on the interior face of said base plate;

a hook secured to said housing; and a rotating hook secured to a rotating locking plate adapted to move within said housing and having at least one ridge corresponding to said at least one groove on said base plate for attachment to said base plate, said rotating hook having a shaft extending through said aperture of said at least one base plate and connected to said locking plate, said rotating locking plate having means for securing to said at least one base plate and adapted to move from a locking position to an unlocked position, said unlocked position allowing a user to reposition said rotating hook to an alternative position for hanging items and said locked position secured to said at least one base plate of said housing thereby preventing movement of said rotating hook.

15. The adjustable hook of claim 14, said locking plate and said at least one base plate having a magnet attachment.

16. The housing of claim 14 further comprising at least two ribs forming the exterior of said housing.

17. The housing of claim 14 further comprising an exterior shell enclosing said locking plate.

* * * * *